US009897374B2

(12) United States Patent
Kim et al.

(10) Patent No.: US 9,897,374 B2
(45) Date of Patent: Feb. 20, 2018

(54) COLD WATER TANK

(75) Inventors: Hyun-Young Kim, Seoul (KR); Woong Jung, Seoul (KR); Hyun-Hee Lee, Seoul (KR); Hwan-Seok Choi, Seoul (KR)

(73) Assignee: Woongjin Coway Co., Ltd (KR)

( * ) Notice: Subject to any disclaimer, the term of this patent is extended or adjusted under 35 U.S.C. 154(b) by 631 days.

(21) Appl. No.: 13/634,132

(22) PCT Filed: Mar. 21, 2011

(86) PCT No.: PCT/KR2011/001929
§ 371 (c)(1),
(2), (4) Date: Sep. 11, 2012

(87) PCT Pub. No.: WO2011/118945
PCT Pub. Date: Sep. 29, 2011

(65) Prior Publication Data

US 2013/0000334 A1 Jan. 3, 2013

(30) Foreign Application Priority Data

Mar. 26, 2010 (KR) ..... 10-2010-0027249
Jun. 30, 2010 (KR) ..... 10-2010-0063111

(51) Int. Cl.
*F25D 17/00* (2006.01)
*F25B 49/00* (2006.01)
*F25D 31/00* (2006.01)

(52) U.S. Cl.
CPC ..... *F25D 31/003* (2013.01)

(58) Field of Classification Search
CPC ..... B65D 51/1644; B65D 51/1633; B65D 51/1605; B65D 51/16; F28D 1/0213;
(Continued)

(56) References Cited

U.S. PATENT DOCUMENTS 1,826,791 A 10/1931 Kellogg
2,495,878 A 1/1950 Tull
(Continued)

FOREIGN PATENT DOCUMENTS

FR 1218774 5/1960
GB 1397000 6/1975
(Continued)

OTHER PUBLICATIONS

PCT/ISA/210 Search Report issued on PCT/KR2010/001929 (pp. 3).
(Continued)

*Primary Examiner* — Jianying Atkisson
*Assistant Examiner* — Meraj A Shaikh
(74) *Attorney, Agent, or Firm* — The Farrell Law Firm, P.C.

(57) ABSTRACT

There is provided a cold water tank including: a first tank having an inlet pipe through which water to be cooled is introduced; and a second tank provided in the interior of the first tank such that water of the first tank can be introduced thereinto, having an evaporator included in a refrigerating cycle to cool the introduced water, and having an outlet pipe through which cooled water flows. Although water is introduced at high pressure, the introduced water can remain in the cold water tank for a period of time required for being cooled, and although water is introduced at high pressure, the introduced water can be in a stable state in the cold water tank. Thus, water can be cooled with its inflow pressure maintained, and the degree of freedom of a faucet or cock for allowing cold water to flow therethrough can be improved in its height.

7 Claims, 4 Drawing Sheets

(58) Field of Classification Search
CPC .. F28D 1/0472; F25C 1/08; F25C 1/12; F25C 2301/00; F25C 2301/002; B01D 35/027; B01D 35/18; B01D 35/183; C02F 2209/02; F25D 21/02; F25D 2323/122; F25D 2331/806
USPC ..... 220/23.89, 23.87, 23.86, 23.83, 203.23, 220/203.19, 203.29, 203.01; 165/163, 165/109.1; 62/129, 434, 389; 210/149, 210/175, 257.1, 136; 222/146.6, 189.06
See application file for complete search history.

(56) References Cited

U.S. PATENT DOCUMENTS

| | | | | |
|---|---|---|---|---|
| 2,720,085 | A * | 10/1955 | Boyle | F25D 16/00 239/225.1 |
| 3,263,442 | A * | 8/1966 | Timmersman | F25D 31/003 62/258 |
| 3,898,856 | A * | 8/1975 | Komedera | F25D 31/003 62/139 |
| 4,934,159 | A * | 6/1990 | Sakai et al. | 62/347 |
| 5,239,836 | A * | 8/1993 | Sakai | 62/233 |
| 6,230,513 | B1 * | 5/2001 | Reinmuth | B67D 1/0857 222/146.6 |
| 6,237,359 | B1 * | 5/2001 | Hebert | 62/348 |
| 6,328,631 | B1 * | 12/2001 | Fukano et al. | 451/39 |
| 6,422,310 | B2 * | 7/2002 | Egara | 165/281 |
| 6,523,498 | B1 * | 2/2003 | Shyu | 119/259 |
| 6,554,200 | B1 * | 4/2003 | Satonaka | 239/2.2 |
| 8,156,748 | B2 * | 4/2012 | Ashrafzadeh | F25C 5/187 62/135 |
| 2002/0124583 | A1 * | 9/2002 | Satoh | F25C 1/08 62/185 |
| 2007/0119193 | A1 * | 5/2007 | Davis et al. | 62/135 |
| 2010/0101244 | A1 * | 4/2010 | Yoshida et al. | 62/66 |
| 2011/0185760 | A1 * | 8/2011 | Suh et al. | 62/344 |
| 2011/0214447 | A1 * | 9/2011 | Bortoletto et al. | 62/340 |

FOREIGN PATENT DOCUMENTS

| | | | | |
|---|---|---|---|---|
| JP | 43-023790 | | 10/1943 | |
| JP | 48-026996 | | 8/1973 | |
| JP | 49-72758 | | 7/1974 | |
| JP | 57-033768 | | 2/1982 | |
| JP | 5733768 | A * | 2/1982 | |
| JP | 61-060078 | | 4/1986 | |
| JP | 62-167075 | | 10/1987 | |
| JP | 03-097172 | | 10/1991 | |
| JP | H0397172 | U * | 10/1991 | |
| JP | 04-125177 | | 11/1992 | |
| JP | H04125177 | U * | 11/1992 | |
| JP | 07146014 | | 6/1995 | |
| JP | 09-033152 | | 2/1997 | |
| JP | 2000-025897 | | 1/2000 | |
| JP | 2002-350028 | | 12/2002 | |
| JP | 2007-240116 | | 9/2007 | |
| JP | 2009-097846 | | 5/2009 | |
| KR | 1019980053406 | | 9/1998 | |
| KR | 200288737 | | 9/2002 | |
| KR | 100476437 | | 7/2005 | |
| KR | 1020090019614 | | 2/2009 | |
| KR | 100924420 | | 10/2009 | |
| KR | 100924420 | B1 * | 10/2009 | F25D 11/00 |

OTHER PUBLICATIONS

PCT/ISA/237 Written Opinion issued on PCT/KR2010/001929 (pp. 3).

European Search Report dated Aug. 10, 2016 issued in counterpart application No. 11759694.0-1605, 7 pages.

* cited by examiner

[Fig. 1]
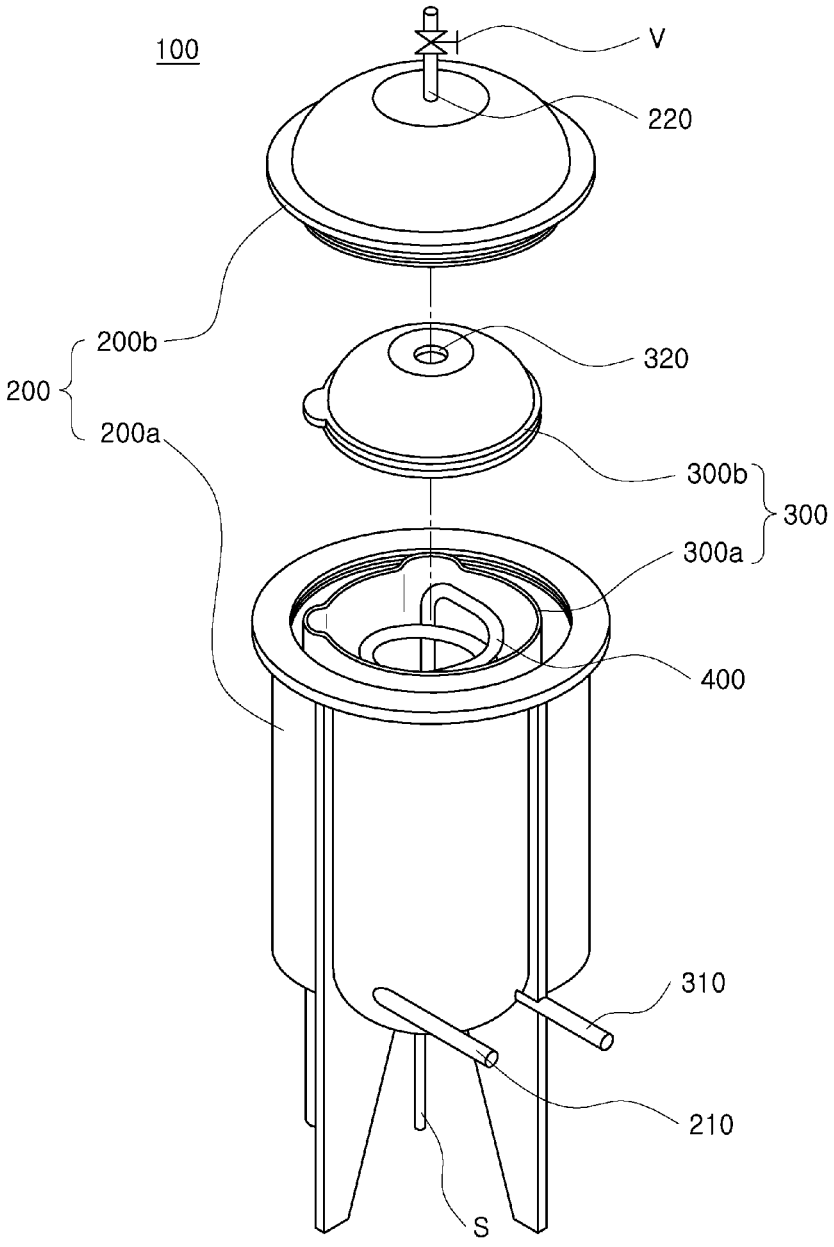

[Fig. 2]
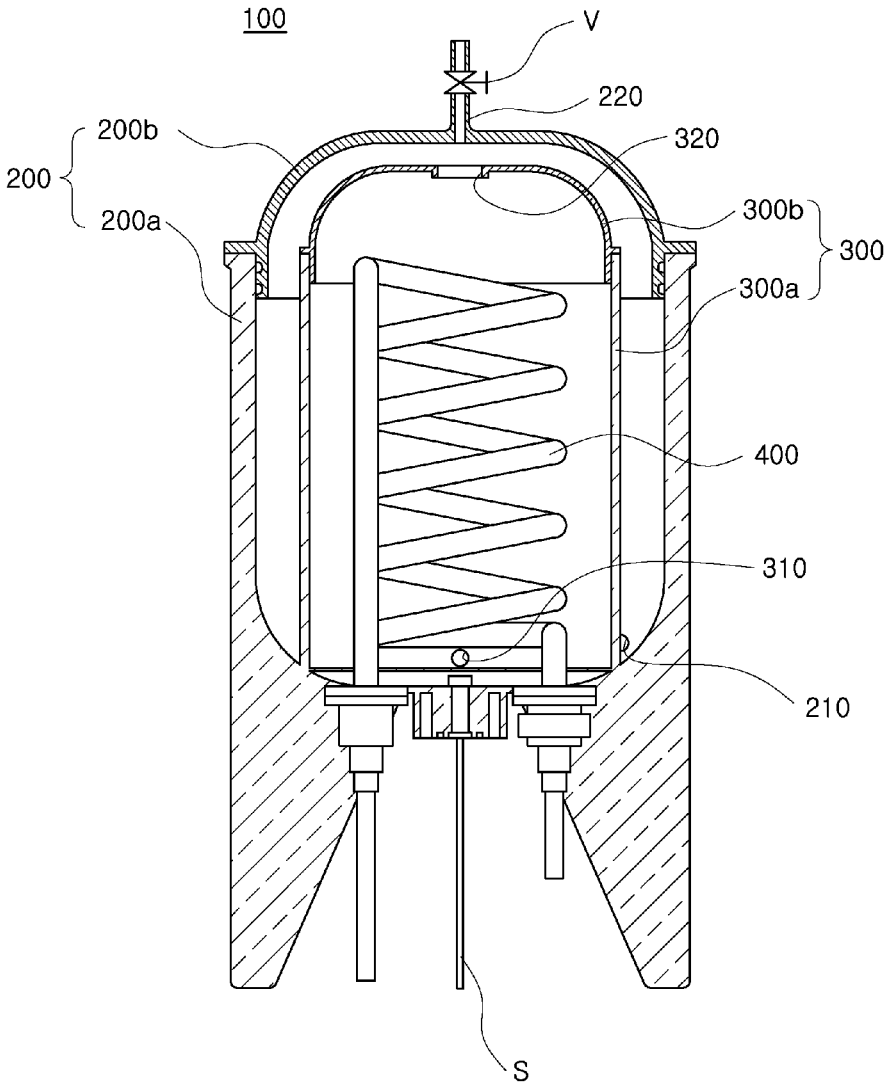

[Fig. 3]
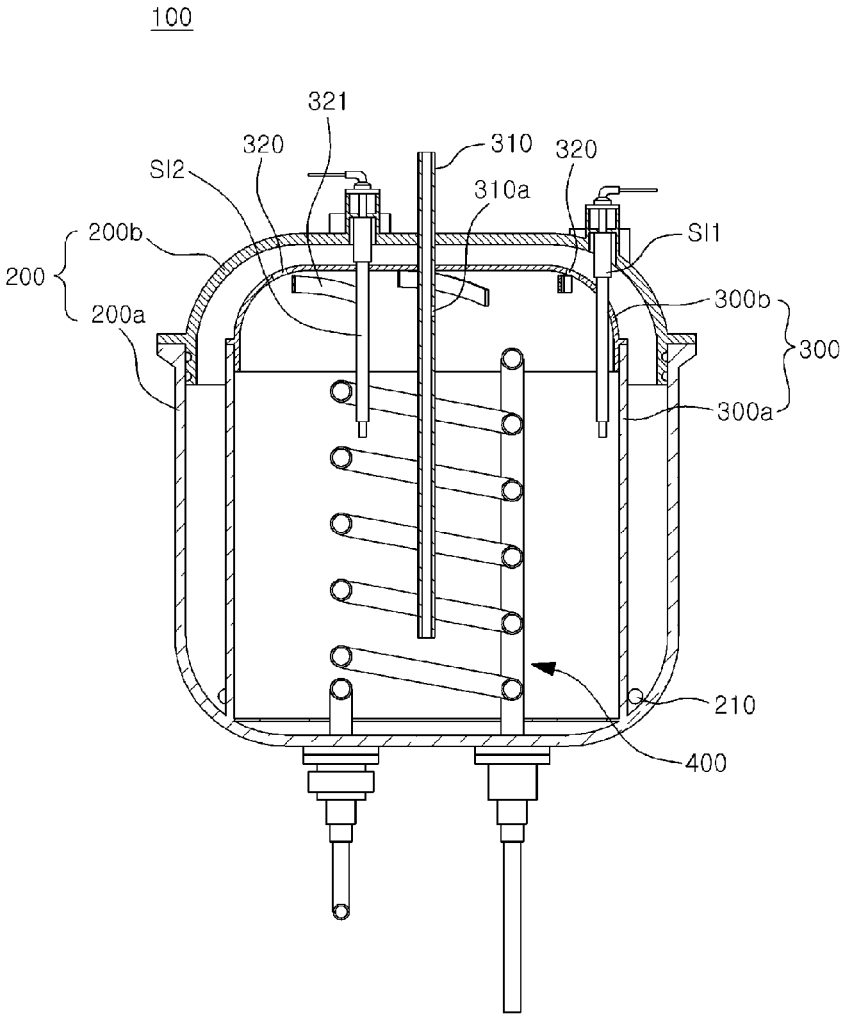
[Fig. 4]
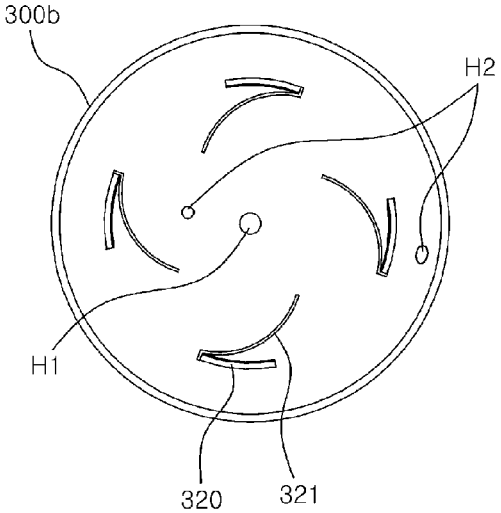

[Fig. 5]
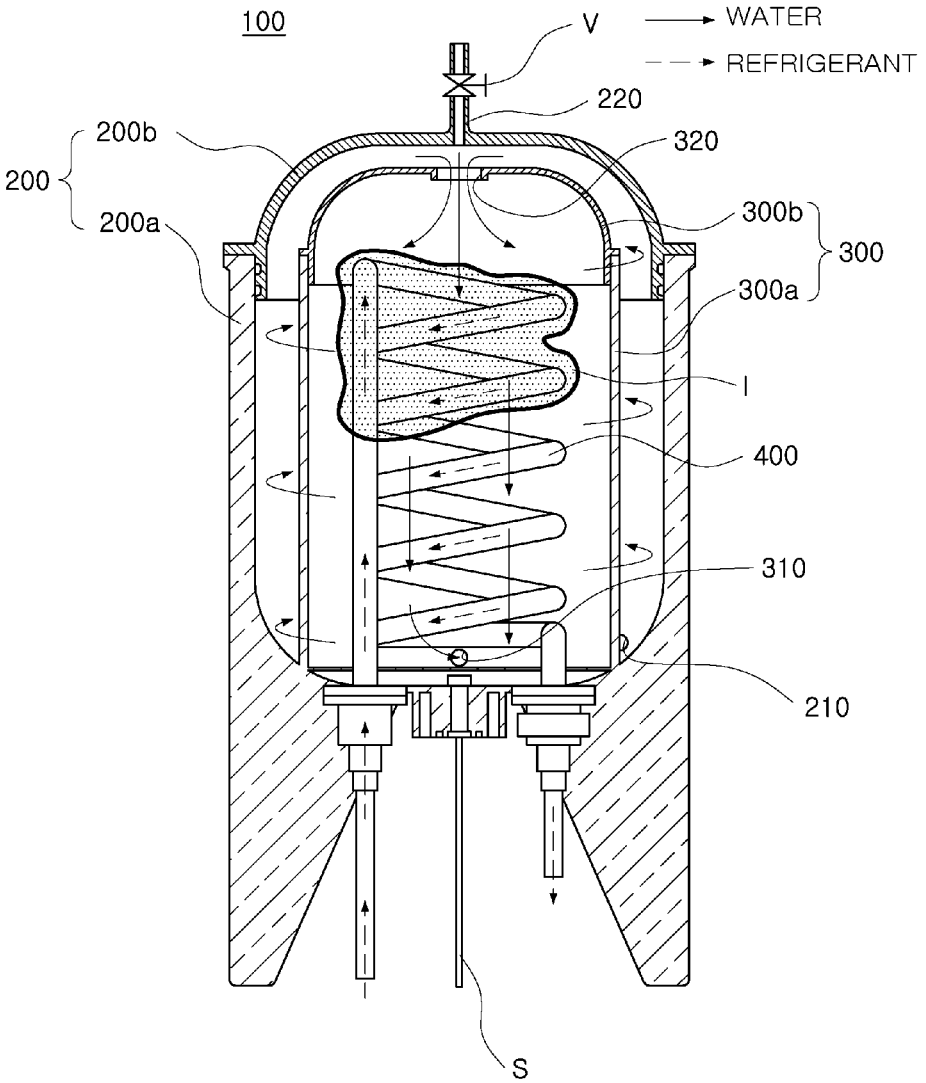

COLD WATER TANK

TECHNICAL FIELD

The present invention relates to a cold water tank capable of cooling water while maintaining an inflow pressure thereof.

BACKGROUND ART

A cold water tank is a device for cooling water introduced thereinto and allowing cold water to flow therefrom.

The cold water tank may be provided in a water purifier, or the like, and water filtered through a plurality of water purifying filters provided in the water purifier is introduced into the cold water tank so as to be cooled. A certain amount of time is required for the water introduced into the cold water tank to be cooled. Also, in order for the water to be easily cooled in the cold water tank, the water must be in a stable state.

However, in the case of a water output when water is discharged from the cold water tank, if the pressure of water introduced into the cold water tank is high, the speed of water introduced into the cold water tank may be fast due to water inflow pressure, potentially shortening a period of time during which water remains in the cold water tank, resulting in water introduced into the cold water tank flowing out without being properly cooled. Also, water quickly introduced into the cold water tank may be mixed with water which has been cooled and stored in the cold water tank, raising the temperature of the cooled water. In particular, the temperature of the water at an outlet side of the cold water tank increases, failing to provide cold water having a desired temperature.

Meanwhile, in order for the water to remain in the cold water tank for a certain period of time so as to be properly cooled, or in order for the water to be in a stable state in the cold water tank, the cold water tank is positioned under a water supply source which is connected to the cold water tank to supply water to the cold water tank. For example, in the case of a direct water type water purifier having a relatively high water pressure, the cold water tank is positioned to be under a water purifying filter that filters water. Accordingly, water is supplied from the water supply source to the cold water tank according to the difference in height between the water supply source and the cold water tank, rather than the water inflow pressure, and in this case, although water is supplied at high pressure from the water supply source to the cold water tank, the pressure of water in the cold water tank is lowered to about an atmospheric pressure.

Thus, a faucet or a cock, connected to the cold water tank to allow water from the cold water tank to flow to the outside, is required to be positioned below the cold water tank to allow water in the cold water tank to be discharged so as to be supplied to a user.

Namely, although water is supplied at a high pressure to the water supply source, e.g., the direct water type water purifier, before the cold water tank, as mentioned above, since the water is supplied according to the difference in height between the water supply source and the cold water tank, rather than the inflow pressure of water, the inflow pressure of water may not be properly maintained.

In addition, since the faucet, the cock, or the like, is required to be positioned at the lower side of the water tank, the degree of freedom in determining the height of the faucet, the cock, or the like, is low.

DISCLOSURE OF INVENTION

Technical Problem

An aspect of the present invention provides a cold water tank allowing water, although being introduced at high pressure, to remain therein for a period of time sufficient to be cooled.

Another aspect of the present invention provides a cold water tank allowing water, although being introduced at high pressure, to be in a stable state so as to be cooled therein.

Another aspect of the present invention provides a cold water tank allowing water to be cooled with its inflow pressure maintained.

Another aspect of the present invention provides a cold water tank including a faucet or a cock, allowing cold water to flow out therethrough, the height of which may be freely determined.

Solution to Problem

According to an aspect of the present invention, there is provided a cold water tank including: a first tank having an inlet pipe through which water to be cooled is introduced; and a second tank provided in the interior of the first tank such that water of the first tank can be introduced thereinto, having an evaporator included in a refrigerating cycle to cool the introduced water, and having an outlet pipe through which cooled water flows out.

The inlet pipe may be provided in a lower portion of the first tank to allow water to be cooled to be introduced from the lower portion of the first tank and flow upward, an inlet hole may be formed at an upper portion of the second tank to allow the water in the first tank to be introduced to the upper portion of the second tank and flow downward in the second tank, and the outlet pipe may be provided in the lower portion of the second tank to allow cooled water to flow out from the lower portion of the second tank.

An air flow pipe having a check valve may be formed at an upper portion of the first tank to allow air included in the interior of the first tank or the second tank to be discharged to the outside.

The second tank may include a temperature sensor.

The outlet pipe may penetrate through the first tank so as to be connected to the second tank.

One end portion of the outlet pipe may be positioned at a lower portion of the second tank to allow cooled water to flow out from the lower portion of the second tank.

An air hole may be formed in the outlet pipe to allow air included in the interior of the first tank or the second tank to be discharged to the outside.

A flow guide may be provided in a portion of the second tank adjacent to the inlet hole to allow water to be rotatably introduced into the second tank through the inlet hole.

The second tank may include an ice size sensor for sensing the size of ice generated at the evaporator.

Advantageous Effects of Invention

According to exemplary embodiments of the invention, although water is introduced at high pressure, the introduced water can remain in the cold water tank for a period of time required for being cooled.

In addition, although water is introduced at high pressure, the introduced water can be in a stable state in the cold water tank.

Also, water can be cooled with its inflow pressure maintained.

Moreover, the degree of freedom of a faucet or a cock for allowing cold water to flow therethrough can be improved in its height.

BRIEF DESCRIPTION OF DRAWINGS

FIG. 1 is an exploded perspective view of a cold water tank according to an exemplary embodiment of the present invention;

FIG. 2 is a sectional view of a cold water tank according to an exemplary embodiment of the present invention;

FIG. 3 is a sectional view of a cold water tank according to another exemplary embodiment of the present invention;

FIG. 4 is a rear view of a second tank cover according to another exemplary embodiment of the present invention; and FIG. 5 is a view showing an operation of the cold water tank according to an exemplary embodiment of the present invention.

MODE FOR THE INVENTION

Hereinafter, exemplary embodiments of the present invention will now be described in detail with reference to the accompanying drawings. The invention may, however, be embodied in many different forms and should not be construed as being limited to the embodiments set forth herein. Rather, these embodiments are provided so that this disclosure will be thorough and complete, and will fully convey the scope of the invention to those skilled in the art. In the drawings, the shapes and dimensions may be exaggerated for clarity, and the same reference numerals will be used throughout to designate the same or like components.

Exemplary embodiments of the present invention include a first tank into which water to be cooled is introduced, with an inflow pressure of water maintained, and a second tank provided in the interior of the first tank, connected to the first tank, having an evaporator to allow introduced water to be cooled, and allowing water to flow out therefrom.

As shown in FIGS. 1 to 3, a cold water tank 100 according to an exemplary embodiment of the present invention may include a first tank 200 and a second tank 300.

Water to be cooled may be introduced into the first tank 200. To this end, as shown in FIGS. 1 to 3, an inlet pipe 210 may be connected to the first tank 200. The inlet pipe 210 may be connected to a water supply source (not shown) such as a water purifying tank (not shown) in which water filtered by a plurality of water purifying filters is stored. Accordingly, water to be cooled may flow into the first tank 200 through the inlet pipe 210. The inlet pipe 210 may be provided in a lower portion of the first tank 200. Thus, water to be cooled may be introduced into the lower portion of the first tank 200 through the inlet pipe 210. Upon being introduced into the lower portion of the first tank 200, water to be cooled, filling the first tank 200, moves (or flows) upward. In the illustrated exemplary embodiment, water to be cooled, introduced through the inlet pipe 210, may move in a spiral manner from the lower portion to an upper portion of the first tank 200. Accordingly, the flow speed of water to be cooled is lowered toward the upper portion of the first tank 200, stabilizing the water flow. Also, the pressure of water when water is introduced can be maintained as it is. That is, the water introduced into the first tank 200 flows from the lower side to the upper side, with its inflow pressure maintained, thus stabilizing the water flow.

The first tank 200 can be hermetically closed, excluding the inlet pipe 210 or an air flow pipe 220 (to be described). Accordingly, the pressure of water introduced into the first tank 200 can be maintained. To this end, as shown in FIGS. 1 to 3, the first tank 200 may include a first tank body **200*a* with an open upper portion and an empty space therein, and a first tank cover 200*b* covering the open upper portion of the first tank body 200*a*. However, the configuration of the first tank 200 is not limited thereto and the first tank 200** may have any configuration so long as it can allow water to be cooled to be introduced thereinto, maintain the inflow pressure of introduced water, and stabilize the water flow.

Meanwhile, as shown in FIGS. 1 and 2, an air flow pipe 220 may be formed on an upper portion of the first tank 200. The air flow pipe 220 may include a check valve (V). Accordingly, when water to be cooled is introduced into the first tank 200 through the inlet pipe 210, air included in the interior of the first tank 200 or the second tank 300 may be discharged to the outside through the air flow pipe 220. In this case, the check valve (V) provided in the air flow pipe 220 allows air included in the interior of the first tank 200 or the second tank 300 to discharged to the outside through the air flow pipe 220 yet prevents external air from being introduced into the first tank 200 or the second tank 300 through the air flow pipe 220. Accordingly, water can be smoothly introduced into the first tank 200 or the second tank 300.

As shown in FIGS. 1 to 3, the second tank 300 may be provided in the interior of the first tank 200 such that water of the first tank 200 can be introduced thereinto. Accordingly, as mentioned above, water is introduced into the first tank 200 and then water stabilized in flow can be introduced into the second tank 300 while its inflow pressure is maintained. To this end, an inlet hole 320 may be formed on an upper portion of the second tank 300. Accordingly, water introduced into the first tank 200 and stabilized in its flow can be introduced to the second tank 300 through the inlet hole 320, while the inflow pressure is being maintained. Since the inlet hole 320 is formed on the upper portion of the second tank 300, the water stabilized in flow, with the inflow pressure maintained, can be introduced to the upper portion of the second tank 300 through the inlet hole 320 and then flow to a lower portion of the second tank 300.

Meanwhile, as shown in FIGS. 1 and 2, one inlet hole 320 may be formed on the upper portion of the second tank 300, or as shown in FIG. 3, two or more inlet holes may be formed. As shown in FIG. 4, a flow guide 321 may be provided in the second tank 300, namely, to a portion of the second tank cover **300*b*, adjacent to the inlet hole 320. Water, flowing in the first tank 200, is stabilized in its flow while the inflow pressure is maintained, and is rotatably introduced to the second tank 300 through the inlet hole 320. Accordingly, water in the vicinity of the evaporator 400 and water of other portions are mixed in the second tank 300, and in this case, the water in the vicinity of the evaporator 400 is not cooled further than that of other portions, resulting in a situation in which water in the second tank 300** can be evenly cooled.

Also, as shown in FIGS. 1 to 3, the evaporator 400 is provided in the interior of the second tank 300. The evaporator 400 may be included in a refrigerating cycle (not shown). Accordingly, a refrigerant flows in the interior of the evaporator 400. The refrigerant flowing in the evaporator 400 and water flowing in the second tank 300, upon being introduced thereto, are heat?exchanged. Namely, heat is transferred from the water flowing in the second tank 300 to the refrigerant flowing in the evaporator 400, cooling the water in the second tank 300. As mentioned above, since the water introduced into the first tank 200 is introduced in a stable state to the second tank 300, water in the second tank 300 can be smoothly cooled. Also, water can be cooled with the inflow pressure thereof maintained.

Meanwhile, as shown in FIG. 5, ice (I) can be generated at the evaporator 400 according to the heat transfer from water introduced to flow in the second tank 300 to the refrigerant flowing in the evaporator 400. Water introduced to flow in the second tank 300 can be cooled by the ice (I) generated in the evaporator 400. Accordingly, water introduced into the second tank 300 can be quickly cooled, improving cooling efficiency.

With reference to FIGS. 1 to 3, an outlet pipe 310 may be connected to the second tank 300. Water cooled as described above can be discharged through the outlet pipe 310. The outlet pipe 310 may be connected to a lower portion of the second tank 300 as shown in FIGS. 1 to 2. Accordingly, water, flowing from the upper portion and the lower portion in the tank 300 so as to be cooled by the evaporator 400 or by the ice (I) generated in the evaporator 400 can flow to a lower side of the second tank 300 through the outlet pipe 310. Thus, water, starting from that present at the lower portion of the second tank 300 having a relatively low temperature can be discharged from the second tank 300.

Also, as shown in FIG. 3, in order for the water cooled by the evaporator 400, while flowing from the upper portion to the lower portion of the second tank 300, to flow out to the lower portion of the second tank 300, the outlet pipe 310 may penetrate through the first tank 300 so as to be connected to the second tank 300. Also, as illustrated, one end portion of the outlet pipe 310 may be positioned at the lower portion of the second tank 300. Accordingly, the cooled water can flow out from the lower portion of the second tank 300.

As shown in FIG. 3, an air flow hole 310*a* may be formed in the outlet pipe 310. With the presence of the air flow hole 310*a*, when water to be cooled is introduced into the first tank 200 through the inlet pipe 210, air included in the interior of the first tank 200 or the second tank 300 can be discharged to the outside through the air flow hole 310*a* and the outlet pipe 310. Accordingly, without the air flow pipe 220 and the check valve (V), air included in the interior of the first tank 200 or the second tank 300 can be discharged to the outside. Thus, water in the first tank 200 or the second tank 300 can be smoothly introduced.

The outlet pipe 310 may be connected to a faucet (not shown), a cock (not shown), or the like. Thus, cooled water flowing out through the outlet pipe 310 of the second tank 300 can flow out through the faucet, the cock, or the like, so as to be supplied to the user.

The second tank 300, excluding the inlet hole 320 or the outlet pipe 310 may be hermetically closed. Accordingly, the pressure of water introduced into the first tank 200 and the second tank 300 can be maintained. To this end, as shown in FIGS. 1 to 3, the second tank 300 may include a second tank body 300*a* with an open upper portion and an empty space therein, and a second tank cover 300*b* covering the open upper portion of the first tank body 300*a*. Also, as shown in FIG. 4 and as described above, the inlet hole 320 may be formed on the second tank cover 300*b*. Also, the second tank cover 300*b* may include an outlet pipe passage hole H1 allowing the outlet pipe 310 to pass therethrough and ice size sensor passage holes H2 allowing ice size sensors SI1 and SI2 to pass therethrough. In addition, the second tank cover 300 further includes the foregoing flow guide 321. However, the configuration of the second tank 300 is not limited thereto and the second tank 300 may have any configuration so long as it can allow water to be cooled to be introduced thereinto, maintain the inflow pressure of introduced water, and stabilize the water flow.

According to the configuration of the first tank 200 and the second tank 300, although water is introduced at high pressure to the cold water tank 100, the introduced water can stay in a stable state for a time sufficient to be cooled in the cold water tank 100.

Thus, water cooled by the evaporator 400 in the second tank 300 is cooled in a state in which the inflow pressure is maintained. Thus, when cooled water flows out through the faucet, the cock, or the like, to the outside, the inflow pressure is maintained. Accordingly, although the faucet, the cock, or the like, is not positioned under the cold water tank 100, cooled water can flow out through the faucet, the cock, or the like. Thus, the height of the faucet, the cock, or the like, can be free.

Meanwhile, as shown in FIGS. 1 and 2, the second tank 300 may include a temperature sensor (S). Thus, temperature of water cooled in the second tank 300 can be adjusted.

Besides, as shown in FIG. 3, the ice size sensors SI1 and SI2 may be provided in the second tank 300 in order to sense the size of ice (I) generated in the evaporator 400. Accordingly, when water introduced to and flowing in the second tank 300 is cooled by the ice (I) generated by the evaporator 400, the degree of cooling thereof can be adjusted by sensing the size of the ice (I). In the present exemplary embodiment, cold refrigerant introduced into the evaporator 400 flows upward in the evaporator 400 and then flows downward in a spiral form in the evaporator 400, the temperature of the refrigerant in the upper portion of the evaporator 400 is lower than that of the lower portion of the evaporator 400. Thus, as shown in FIG. 5, ice (I) is generated, starting from the upper portion of the evaporator 400. Accordingly, when the thickness of ice (I) generated in the evaporator 400 is thin, the size of the ice (I) is sensed by the ice size sensor SI2, and when the thickness of the ice (I) is thick, the size of the ice (I) is sensed by the ice size sensor SI1. Thus, when the size of the ice (I) is sensed by the ice size sensor SI2, the flow amount of the cold refrigerant flowing in the evaporator 400 is increased or the temperature is lowered to strengthen the degree of cooling water, and when the size of the ice (I) is sensed by the ice size sensor (SI1), the flow amount of the cold refrigerant flowing in the evaporator 400 is reduced or the temperature is increased to lessen the degree of cooling water, thus adjusting the degree of cooling water.

The operation of the cold water tank 100 according to an exemplary embodiment of the present invention will now be described with reference to FIG. 5.

First, the inlet pipe 210 of the first tank 200 is connected to a water supply source (not shown), such as a direct water type water purifier (not shown). Then, the outlet pipe 310 of the second tank 300 is connected to a faucet, a cock, or the like. Thereafter, when the direct water type water purifier, or the like, operates, water to be cooled is filtered in the direct water type purifier (not shown), or the like, is introduced into the interior of the first tank 200 through the inlet pipe 210 of the first tank 200.

In this case, the water to be cooled is introduced into the interior of the first tank 200 through the inlet pipe 210 at a fast speed owing to the inflow pressure. In line with this, air included in the first tank 200 or the second tank 300 is discharged to the outside through the air flow pipe 220 of the first tank 200. As shown in FIG. 3, the water introduced to the first tank 200 through the inlet pipe 210 flows from the lower portion to the upper portion in the first tank 200 while rotating in the interior of the first tank 200. Namely, the water flows in a spiral form in the interior of the first tank 200. The speed of the water, which flows in the spiral form after being introduced into the interior of the first tank 200, is reduced while it flows from the lower portion to the upper portion in the first tank 200. Accordingly, the water flow is stabilized. However, the inflow pressure of the water is maintained, rather than being degraded.

In this manner, the water, in a stable state with the inflow pressure maintained and with the speed reduced, is introduced into the second tank 300 through the inlet hole 320 of the second tank 300 connected to the first tank 200 as shown in FIG. 5. The water introduced into the second tank 300, flowing from the upper side to the lower side in the second tank 300, is cooled by the evaporator 400 provided in the second tank 300. As shown in FIG. 5, a refrigerant flows in the interior of the evaporator 400. Accordingly, the refrigerant flowing in the evaporator 400 and water flowing in the second tank 300 are heat?exchanged. Namely, heat is transferred from the water flowing in the second tank 300 to the refrigerant flowing in the evaporator 400, cooling the water in the second tank 300.

Meanwhile, as shown in FIG. 5, ice (I) can be generated in the vicinity of the evaporator 400 according to the heat exchange. Thus, water introduced into the second tank 300 can be cooled by the heat exchange with the ice (I), namely, by the heat transfer from the water introduced into the second tank 300 to the ice (I). Accordingly, water introduced into the second tank 300 can be more effectively cooled.

The water, flowing from the upper portion to the lower portion in the second tank 300, cooled by the evaporator 400 or by the ice (I) formed at the evaporator may flow out through the outlet pipe 310 of the second tank 300. The cold water flowing out through the outlet pipe 310 can be provided to the user through a faucet (not shown), a cock (not shown), or the like. As mentioned above, the inflow pressure of the water flowing out through the faucet, the cock, or the like, is maintained. Thus, the faucet, the cock, or the like, may have any height at which water can reach the faucet, the cock, or the like, by the inflow pressure. Thus, the height of the faucet, the cock, or the like, can be freely determined.

As set forth above, the use of the cold water tank 100 according to exemplary embodiments of the invention, has the following advantages. That is, although water is introduced at high pressure, the introduced water can remain in the cold water tank for a period of time required for being cooled, and although water is introduced at high pressure, the introduced water can be in a stable state in the cold water tank 100. Thus, water can be cooled with its inflow pressure maintained, and the degree of freedom of a faucet or a cock for allowing cold water to flow therethrough can be improved in its height.

While the present invention has been shown and described in connection with the exemplary embodiments, it will be apparent to those skilled in the art that modifications and variations can be made without departing from the spirit and scope of the invention as defined by the appended claims.

The invention claimed is:

1. A cold water tank comprising:

a first tank having an inlet pipe through which water to be cooled is introduced into the first tank; and a second tank provided in the interior of the first tank such that water of the first tank can be introduced into the second tank, having an evaporator included in a refrigerating cycle to cool the water introduced into the second tank, and having an outlet pipe through which cooled water flows out, wherein the first tank includes a first tank body with an empty space therein and a first tank cover covering an open upper portion of the first tank body, wherein the second tank includes a second tank body with an empty space therein, a second tank cover covering an open upper portion of the second tank body, and an ice size sensor for sensing a size of ice generated at the evaporator, wherein the ice sensor is a direct contact type sensor, wherein a plurality of inlet holes are formed at the second tank to allow the water in the first tank to be introduced into the outside of the evaporator in the second tank, wherein a plurality of flow guides are provided in a portion of the second tank adjacent to the plurality of the inlet holes respectively to allow water to be rotationally introduced into the second tank through the plurality of the inlet holes, wherein the plurality of the flow guides are curved from the plurality of the inlet holes toward the center portion of the second tank respectively, and wherein the water introduced into the second tank through the inlet holes flows rotationally from the outside of the evaporator toward the evaporator in the second tank by the flow guides so that the water in the vicinity of the evaporator and water of other portions of the second tank are mixed in the second tank.

2. The cold water tank of claim 1, wherein the inlet pipe is provided in a lower portion of the first tank to allow water to be cooled to be introduced from the lower portion of the first tank and flow upward, the plurality of the inlet holes are formed at an upper portion of the second tank to allow the water in the first tank to be introduced to the upper portion of the second tank and flow downward in the second tank, and the outlet pipe is provided in a lower portion of the second tank to allow cooled water to flow out from the lower portion of the second tank.

3. The cold water tank of claim 1, wherein an air flow pipe having a check valve is formed at an upper portion of the first tank to allow air included in the interior of the first tank or the second tank to be discharged to the outside.

4. The cold water tank of claim 1, wherein the second tank comprises a temperature sensor.

5. The cold water tank of claim 1, wherein the outlet pipe penetrates through the first tank to connect to the second tank.

6. The cold water tank of claim 5, wherein one end portion of the outlet pipe is positioned at a lower portion of the second tank to allow cooled water to flow out from the lower portion of the second tank.

7. The cold water tank of claim 5, wherein an air hole is formed in the outlet pipe to allow air included in the interior of the first tank or the second tank to be discharged to the outside.

* * * * *